US006843408B1

(12) United States Patent
Agren

(10) Patent No.: US 6,843,408 B1
(45) Date of Patent: Jan. 18, 2005

(54) DEVICE IN PACKAGING

(76) Inventor: Goran Agren, Persborg 8, S-805 95, Gävle (SE)

( * ) Notice: Subject to any disclaimer, the term of this patent is extended or adjusted under 35 U.S.C. 154(b) by 0 days.

(21) Appl. No.: 09/857,103

(22) PCT Filed: Dec. 3, 1999

(86) PCT No.: PCT/SE99/02266

§ 371 (c)(1),
(2), (4) Date: Jun. 19, 2003

(87) PCT Pub. No.: WO00/35760

PCT Pub. Date: Jun. 22, 2000

(51) Int. Cl.[7] ..... B65D 5/00

(52) U.S. Cl. ..... 229/167; 229/172; 229/178; 206/784; 206/738; 206/45.29

(58) Field of Search ..... 206/736, 738, 206/784, 45.29, 45.28; 229/172–174, 167, 178, 147, 193, 243

(56) References Cited

U.S. PATENT DOCUMENTS 2,345,716 A * 4/1944 Smith ..... 229/167
2,447,243 A * 8/1948 Glidden et al. ..... 229/167
2,647,621 A * 8/1953 Bowden ..... 206/738
3,227,355 A * 1/1966 Davidson ..... 229/167
3,335,936 A * 8/1967 Manuel et al. ..... 229/167
3,499,597 A * 3/1970 Katzman ..... 206/525
3,539,094 A * 11/1970 Collura et al. ..... 229/167
3,744,706 A * 7/1973 Colantoni et al. ..... 229/167
4,003,514 A * 1/1977 Graser ..... 229/123.2
4,026,411 A * 5/1977 Johnson ..... 206/784

* cited by examiner

*Primary Examiner*—Jila M. Mohandesi
(74) *Attorney, Agent, or Firm*—Pierce Atwood; Kevin M. Farrell

(57) ABSTRACT

A device at a package comprises a bottom and walls protruding upwards therefrom. The package is formed by a foldable blank and comprises an arrangement for locking the package in its erected state. The locking arrangement comprises locking tips (25, 26, 32, 33) connected to a wall, which locking tips are located inside a cavity in an adjoining wall in the erected state of the package and arranged to lock the wall first mentioned by bearing upon an upper panel portion (21, 23) of the adjoining wall from the inside.

6 Claims, 8 Drawing Sheets

Fig 11
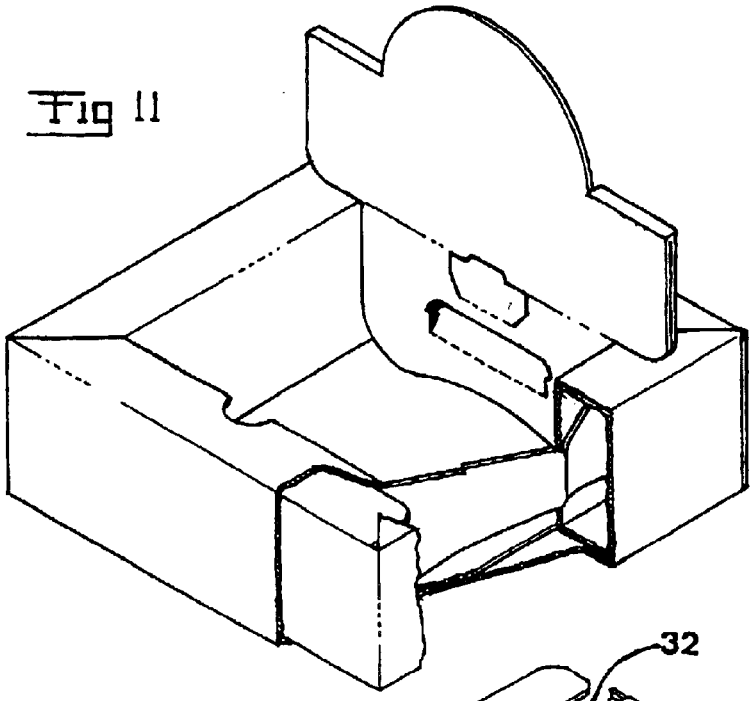
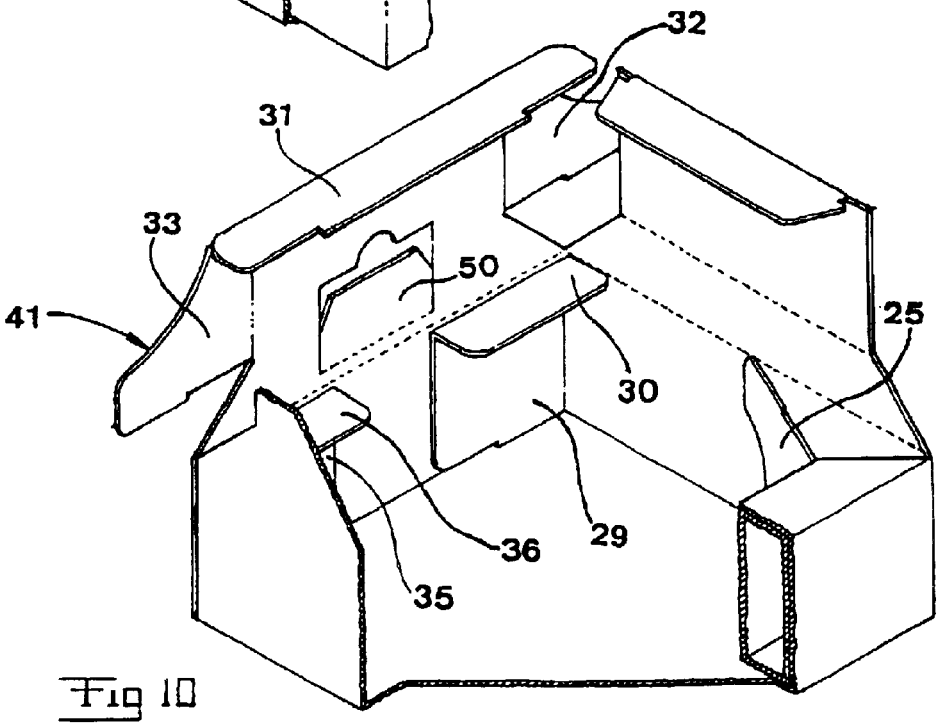
Fig 10

DEVICE IN PACKAGING

FIELD OF THE INVENTION AND PRIOR ART

The present invention relates to devices at packages according to the precharacterizing parts of the subsequent claims 1, 8 and 17.

At packages already known there are drawbacks which it has not been succeeded to remove until today. For example at packages of the type it is related to in the precharacterizing part of the subsequent claim 1 it is desirable to secure that the package is given good stability. For this purpose it is known to design the foldable blank with locking tips, flaps or the like but any satisfactory solution has not been achieved yet. Further, it is known to try to remove the problem of stability by means of glue joints, tapings etc. However, the disadvantage by such solutions is that it becomes difficult or impossible to bring the package into a collapsed state. Further, the work to bring the package into its erected state is complicated.

As an example of prior art reference is made to U.S. Pat. No. 2,447,243.

The device defined in the precharacterizing part of the subsequent claim 8 is known by. GB 476 873. Although the device illustrated therein solves the problem for distributors to expose the packed products for potential customers in a good way the disadvantage that the cover has a very unstable design is present. It would be desired to arrive to a more solid construction without for that reason effecting the possibilities of exposing the products in a negative way.

In connection with the package device defined in the precharacterizing part of the subsequent claim 18, which has correspondance in the description of U.S. Pat. No. 5,223,121 It Is established that the known device in some using situations is unsuitable because it is based on a design in which the cover is integrally joined with the rest of the package. Further, in the device already known the members for locking the cover in the closed position are unsatisfactory designed.

SUMMARY OF THE INVENTION

The Object of the Invention

One primary object of the invention is to develop the prior art according to the precharacterizing part of the subsequent claim 1 in a way that a substantial improved locking of the package in its erected state may be achieved by in this connection well acceptable measures.

According to a secondary aspect of the invention it is intended to improve the prior art according to the precharacterizing part of claim 8 in a way that the cover of the package is given stability.

According to a third aspect of the invention the object is to create possibilities for a convenient and safe function regarding locking and releasing of cover at the device according to the precharacterizing part of the claim 18.

THE SOLUTIONS ACCORDING TO THE INVENTION

In accordance with the primary aspect of the invention the object propounded is performed by what is defined in the characterizing part of claim 1. The flaps and the locking tips defined will efficiently lock the package in its erected state without making it necessary to resort to measures such as gluing, stitching etc.

According to a second aspect of the invention the object propounded is performed by what appears from the characterizing part of the claim 8. A very stable cover construction is by that obtained, which not intrudes on the manoeuvrebility of the cover construction for exposing purposes.

According to the characterizing part of the subsequent claim 18 the third aspect of the invention has its object satisfied by resorting to the locking tips defined, which tips automatically moves into locking and releasing function, respectively, when the present cover portion is pivoted for closing and opening, respectively.

BRIEF DESCRIPTION OF THE DRAWINGS

With reference to the appended drawings below follows a description in more detail of preferred embodiments of the invention cited as examples.

In the drawings:

FIG. 10 is a view similar to the view in FIG. 9 but illustrating the package in an even more collapsed state, FIG. 11 is an enlarged view similar to the view in FIG. 7 but in addition partly cut.

DETAILED DESCRIPTION OF PREFERRED EMBODIMENTS

Figure 1:
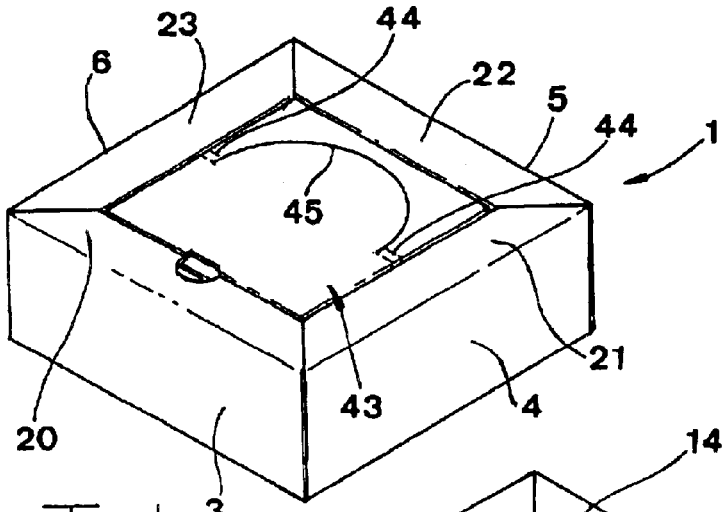
FIG. 1 is a perspective view of the package according to the invention including an attachment forming a cover.
Figure 2:
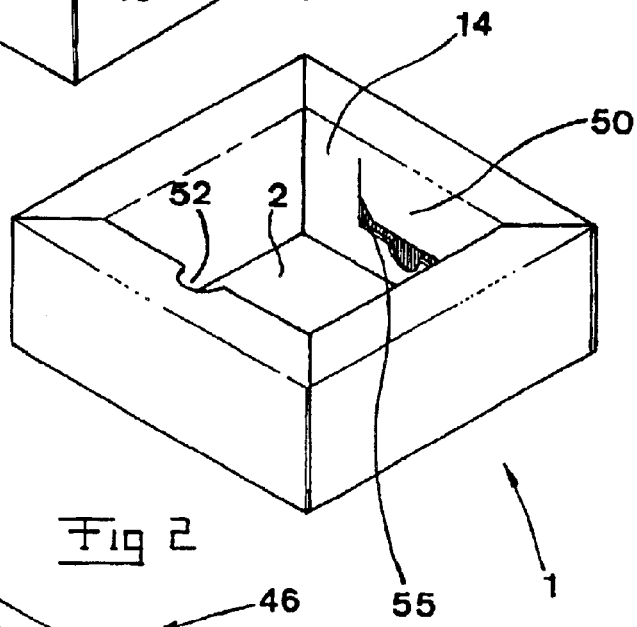
FIG. 2 is a view similar to FIG. 1 without the attachment.

In FIGS. 1 and 2 a package comprising a bottom 2 and four hollow walls 3–6 protruding upwards therefrom generally denoted by 1 is illustrated. The package is formed by a foldable blank illustrated in FIG. 12 in a plane unfolded state, which blank has a bottom portion 7, wall assemblies 8–11 with internal 12–15 and external 16–19 wall portions for forming the hollow walls 3–6 and panel portions 20–23, which form upper edges of the walls of the package and connect the Internal and external wall portions to each other.

In addition the package is provided with an arrangement for locking the package in its erected state. This arrangement comprises among other things locking tips denoted with 25, 26, 32, 33.

More precisely, the locking arrangement comprises locking tips 25; 32 respective 26; 33 included in two opposite first wall assemblies 8, 10, which locking tips in the erected state of the package (see especially FIG. 9) are located inside a respective wall 4 respective 6 formed by a second wall assembly 9, 11, and are arranged to lock the walls 3 and 5 in place by bearing against the inner side of the panel portions 21, 23 on their inner side. By the fact that the locking tips 25, 26, 32, 33 in this way will be holded down with assistance of the panel portions 21 and 23 the internal wall portions 12, 14, which are connected with locking tips via respective folding lines, will be prevented from pivoting in a direction towards the interior of the receptacle in releasing direction. The locking tips are designed with a suitable length so that the lever arm conditions required are achieved. From FIG. 9 it appears that the locking tips on their upper edges may have cutting-outs 77, which have the purpose to secure that it will be the outer ends of the locking tips that contact the lower side of the panel portions 21, 23 so that a great lever arm is achieved. As also will be clear from FIGS. 9 and 10 the device is such that the outer ends of the locking tips will be located fairly close to the folding line between the external wall portions 17 respective 19 included in the walls 4, 6 and the panel portions 21 respective 23. This location of the points of attack of the force of the locking tips means that substantially the external wall portions 17 and 19 will act force transferring without applying any such great moment on the panel portions 21 and 23 so that is a risk present that the package unintentionally is effected in an unlocking direction.

Figure 9:
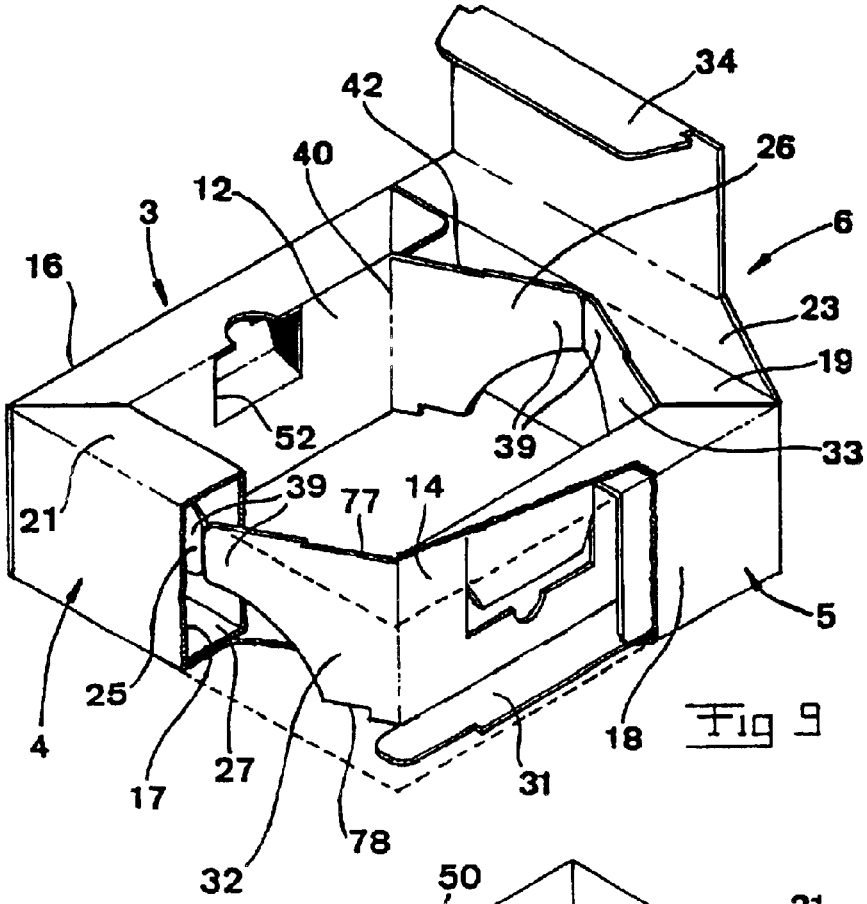
FIG. 9 is a view illustrating the receptacle itself cut up and partly opened.
Figure 8:
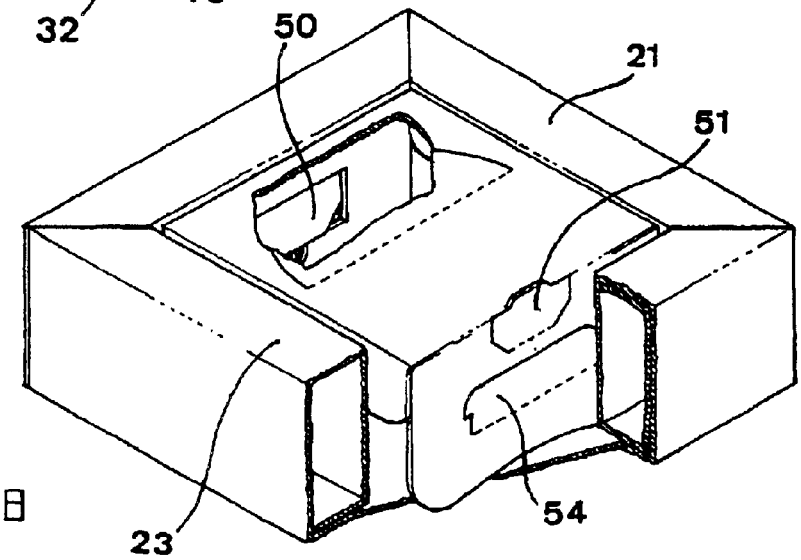
FIG. 8 is a partly cut view of the package with its attachment.

It appears from FIG. 9 how the locking tips 25 and 26 via folding lines 40 are connected with the Internal wall portion 12 of the wall 3 while the locking tips 32, 33 are connected with the Internal wall portion 14 of the wall 5. At the top these wall portions 12, 14 are held substantially parallel to each other but at a distance in relation to external wall portions 16, 17 included in the walls 3 respective 5 by means of the panel portions 20, 22. Flaps 24 respective 31 (see both FIGS. 9 and 12) function as spacers between the respective Internal and external wall portions 12; 16 respective 14; 18 in the lower area of the package. The flaps 24 and 31 are located above the bottom 7 and may bear against this and bear with their outer edges upon the inner side of the outer wall portions 16, 18.

Flaps 27 and 34 which connect to the Internal wall portions 13, 15 included in the wall assemblies 9, 11 work as locking members for these, i.e. for locking of the interal and external wall portions of the walls 4 respective 6 in a substantially parallel condition at a mutual distance. The flaps 24 and 31 will be located in the bottom area of the package below the upper panel portions 20 respective 22 in the same way that the flaps 27 respective 34 will be located in the bottom area of the package below the panel portions 21 respective 23 associated thereto. Thus, the hollow character of the walls 3–6 is established.

Inclined bevels for example on the panel portions 21–24 are present in a conventional way for making the panel portions to fit together and support edge against edge to each other in the corner area of the package.

Especially from FIG. 10 it appears how flaps 27–28 are included in the package in its erected state: more precisely this is illustrated in FIG. 10 by means of the flaps 29/30 and 35/36. To be more precise, these flaps work for erecting the wall assemblies 9, 11 respective 8, 10 and are located in the corner area of the package.

Thus, the locking tips 25, 26 respective 32, 33 are connected with the internal wall portions 12 respective 14 of the walls 3, 5 and lock these by being located below the panel portions 21, 23, 20 which are locked by means of the Internal wall portions 13, 15 and the flaps 27, 34.

It is preferred that the locking tips 25, 26, 32, 33 extend obliquely from their points of attachment in relation to the inner walls 12, 14 out towards the ends 39 of the tips. This obliquity means that the ends 39 of the supporting tips will be located close to the folding line between the panel portions 21, 23 and the outer wall portions 17, 19. It appears from FIG. 10 for instance that the supporting tips are provided with cutting-outs 41. These have the task to facilitate the folding of the package.

It appears from for instance FIGS. 9 and 11 that the ends 39 of the locking tips may bear against each other in pairs. It is stressed that this is not a demand. On the other hand such a bearing 35 may result in the advantage that the locking tips are held at an adequate place in a safer way with their ends close to or in contact with the external wall portions of the walls 4 and 6, i.e. that the locking tips not unintentionally become located closer or next to the internal wall portions of these wails 4, 6.

Figure 12:
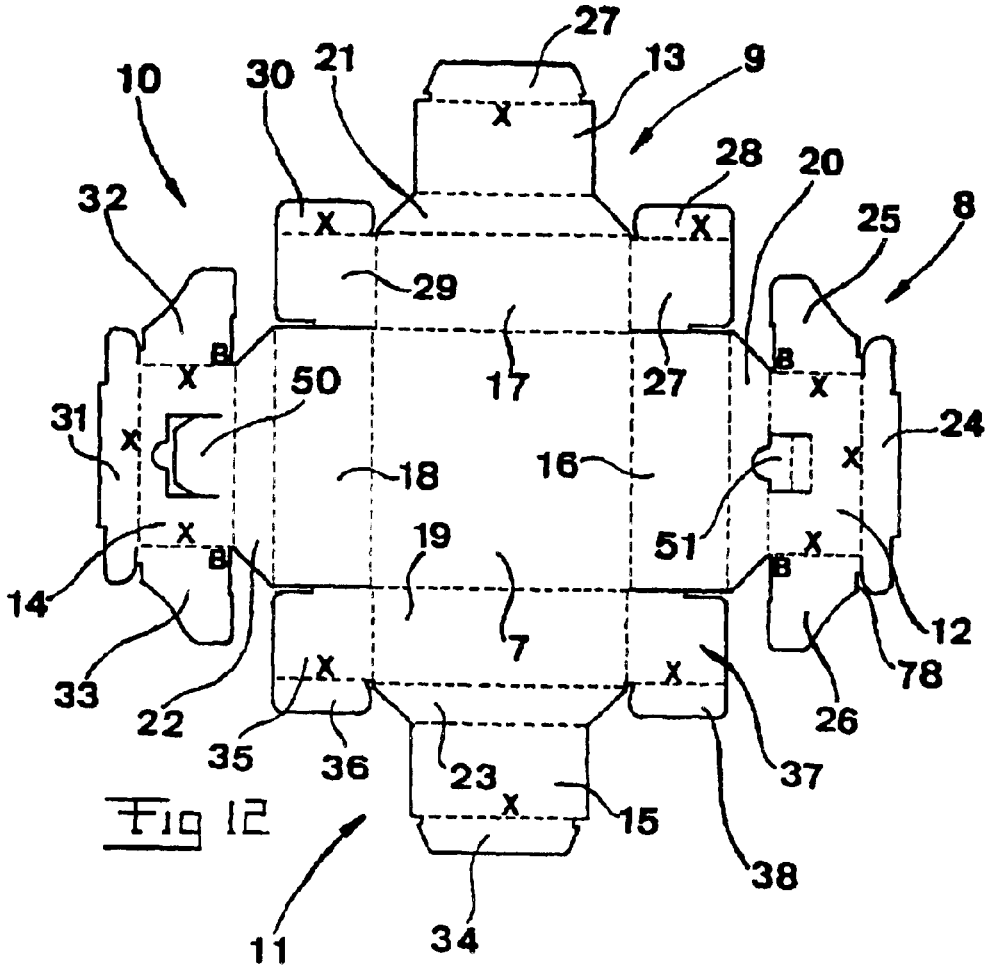
FIG. 12 is a elevation view illustrating a foldable blank in a plane state intended for forming the package.

From FIGS. 9 and 12 for instance it appears that in the lower part the locking tips are provided with cutting-outs 78. These have the purpose of allowing the flaps 27 and 34 of the walls 4, 6 to be moved in under the locking tips, where the flaps 27, 34 will be kept in place in an efficient way.

When erecting the package with start from the plane position according to FIG. 12 first the wall assemblies 8, 10 having the locking tips are pivoted upwards and inwards toward the middle of the package so that the walls 3 and 5 are formed. Thereafter the wall assemblies 9 and 11 are pivoted upwards and inwards for forming the walls 4, 6. By the fact that the flaps 27, 34 are pivoted in under the locking tips to the end position that is illustrated for the flap 27 in FIG. 9 the package in its entirety will be well locked in its erected state.

Figure 5:
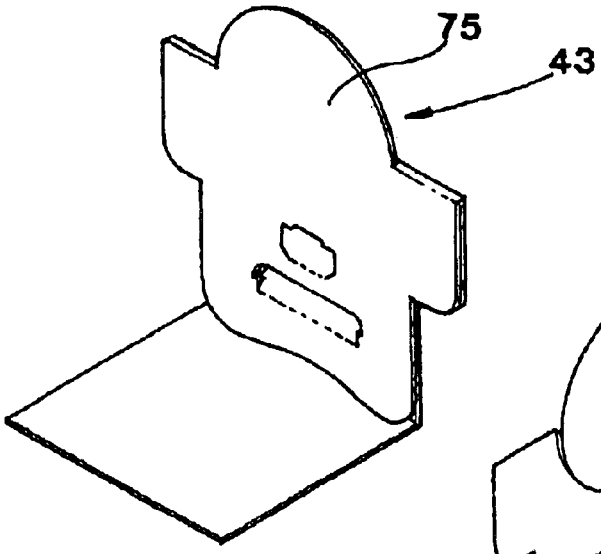
Figure 6:
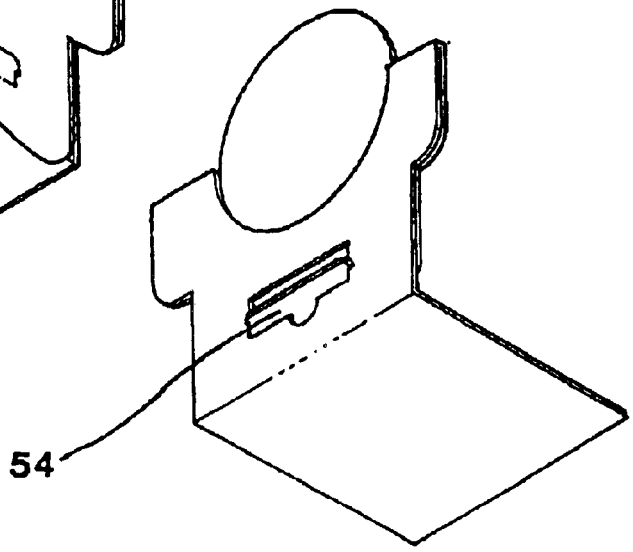
Figure 4:
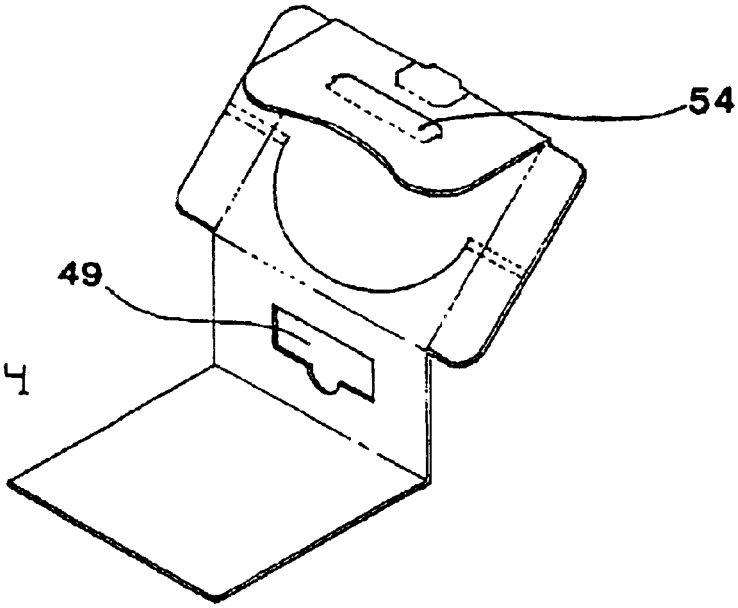
FIG. 4 is a developed view of the attachment according to FIG. 3, FIGS. 5 and 6 are perspective views of the attachment according to FIGS. 3 and 4 in the position when the cover of the attachment is double folded.

In FIG. 1 a cover generally denoted with 43 is illustrated. These cover is provided with a folding notch 44 for enabling folding of the cover to a double folded state illustrated in FIGS. 5, 6 and 7, in which state the cover is located at one of the walls of the package while leaving mainly the whole room in the package free and while protruding upwards above the upper edge of the walls of the package. The cover 43 (FIGS. 1 and 7) has in the example a cut 45, the ends of which connect to the folding notch 44 and the extention of which is different from the folding notch 44 for providing the outline of the cover desired in its double folded state when double folding the cover.

The described cut 44 is in the example substantially semicircular, which means that when the cover is double folded it will 35 have a semicircular portion 75 at the top.

Figure 3:
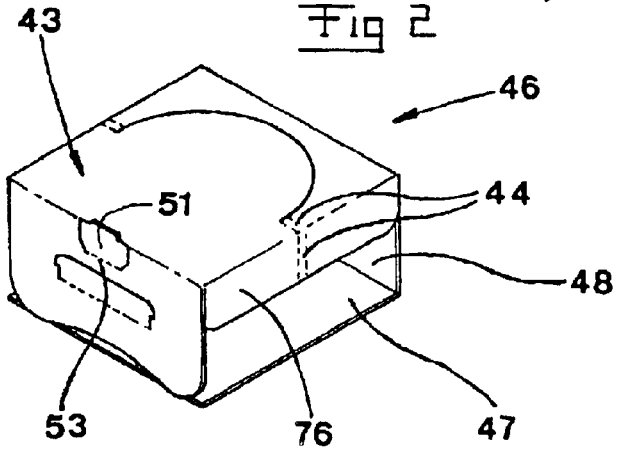
FIG. 3 is a view similar to the view in FIG. 1 but showing the attachment itself only.

In FIG. 3 the cover 43 is illustrated. This has flaps 76 along two edges extending substantially perpendicularly to the folding line 44 (see also the unfolded blank in FIG. 13). These flaps 76 protrude into the interior of the package in the closed position of the cover. The folding line 44 extends across the flaps 76 so that also the flaps 76 are double folded in the double folded state of the cover and more precisely so that they lay substantially in parallelism with the plane of the double folded cover 43. In the closed position of the cover the flaps 76 will stabilise the cover since they extend perpendicularly to the main plane of the cover.

Figure 13:
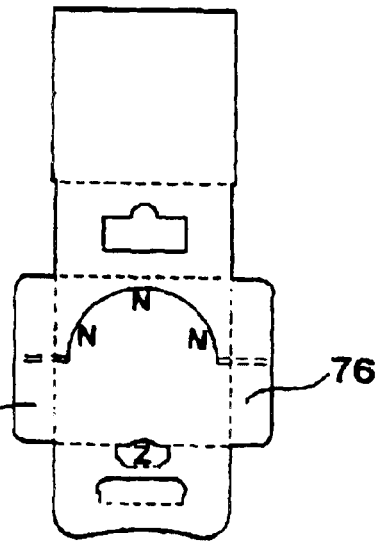
FIG. 13 is a similar view of the attachment itself.

In FIGS. 12 and 13 the reference x is intended to indicate folding lines established by means of several perforations preplaced in line with each other. By the letter N longer continues cuts are denoted. With the letter Z only separate knife cuts are denoted. Finally with the letter B folding lines achieved by means of foldIng are denoted.

The cover 43 forms part of an attachment placeable in the package and generally denoted by 46. The attachment 46 and the package 1 comprise co-operating locking means for locking the attachment in the state illustrated in FIGS. 1 and 3, in which the cover 43 is closed, and in a second state, in which the cover 43 is double folded.

The attachment 46 has a bottom portion 47 for placing against the bottom 2 of the package and a panel element 48 connecting the bottom portion and a cover portion of the attachment which panel element extends along and closed to one of the walls of the package when the attachments are placed in the package.

Either the panel element 48 or the package 1 itself has a recess 49 while a first locking tip 50 designed in the adjoining wall 14 of the package is introducable in the recess 49 for locking purposes. In the example it is illustrated how the recess 49 is arranged in the panel element 48 of the attachment while the locking tip 50, which is receivable in the recess 49, is arranged to on the opposite side of the package, namely the side denoted 5. Thus, the locking tip 50 is intended to be introduced in the recess 49 for locking the attachment in place.

The locking means for locking the attachment in its first state, in which the cover is closed, comprise a second locking tip 51 which may be arranged on the package 1 but which is illustrated as being arranged on the attachment herein. This locking tip is intended for engagement with a second recess 52 on either the package 1 or the attachment 46 itself. In the example the locking tip 51 has been designed on the attachment. Itself while the recess 52 is arranged on the package. Certainly, an inversion would be possible. When the locking tip 51 is inserted outwards from the attachment into the recess 52 the portion of the package being above the recess 52 will prevent unintentionally withdrawal of the locking tip 51 out of the recess 52, unless inappropriate forces are excerted. For releasing the engagement of the locking tip 51 in the recess 52 the tip 51 may be moved in a direction toward the attachment 46, i.e. away from the recess 52 but it also would be possible to push the tip 5 even longer into the recess 52 so that in a subsequent lifting of the cover 43 the locking tip 51 pivots away by performing a pivot motion about the folding line 53 in relation to the attachment.

Figure 7:
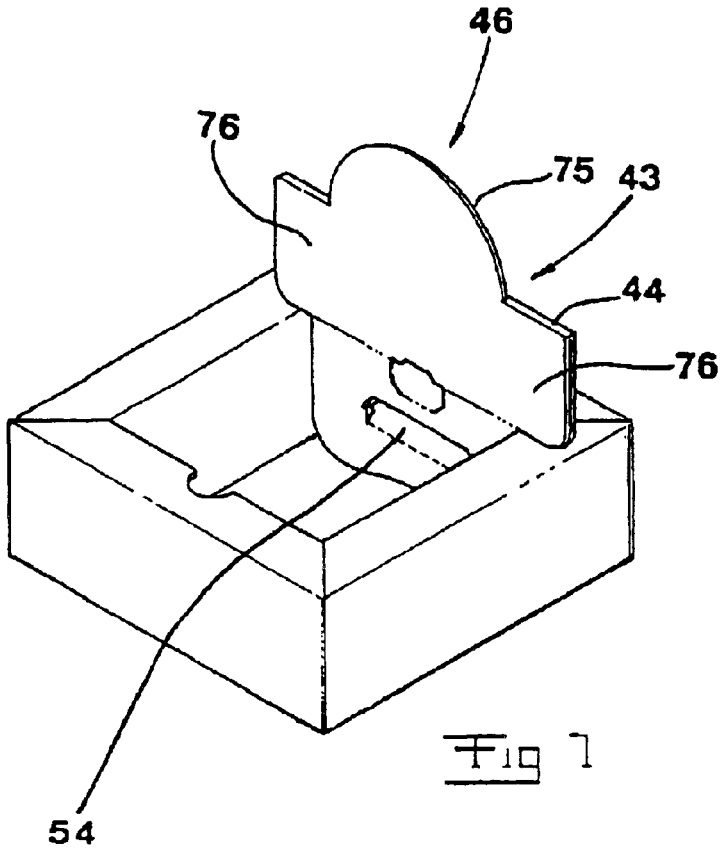
FIG. 7 is a view similar to FIG. 1 but illustrating the attachment in its position according to FIG. 5.

The attachment 46 has also a third locking tip 54 arranged to engage with the recess 49 arranged in the panel element 48 in the double folded state (see FIGS. 7 and 11) of the cover 43 and one further recess 55 in the Internal wall portion 12 of the wall 1 for holding the cover and the entire attachment in its position according to FIGS. 7 and 11. In the example the recess 55 is that recess that results when cutting-out the locking tip 50. When the locking tip 54 is inserted into the recesses 49, 55 the locking tip 50 will be moved away into the inner cavity of the wall 1.

Thus, when the package and the attachment 46 are in the position according to FIG. 7 a product placed in the package may be exposed for the observer by the fact that the inner room in the package is uncovered and further the attachment 46 now serving as a sign or information board, which attachment forms a plane structure along one of the walls of the package, may be provided with informations suitable for the purpose, such as advertising copy, cost etc. so that the observer receives the information desired together with the fact that he may study the uncovered product visually. Thus, from the above it appears that the package and the attachment 46 form both emballage for storage and transportion and a presentation arrangement.

It is pointed out that certainly the semicircular shape of the cut 45 may be replaced by any other shape desired in this connection. Besides, it would be possible to allow the folding line 44 to extend continuously in a straight line over the whole cover without any cut corresponding to that denoted with 45 present, in which case the double folded cover would have an upper edge formed by the folding line which edge would be completely straight, such a embodiment is within the scope of the idea of the invention in the general shape thereof.

By the fact that the attachment 46 has side flaps 76, which in the double folded state will be located above the upper parallel portions of two opposite package walls during bearing thereagainst, the attachment 46 will receive good locking in its double folded state.

Figure 14:
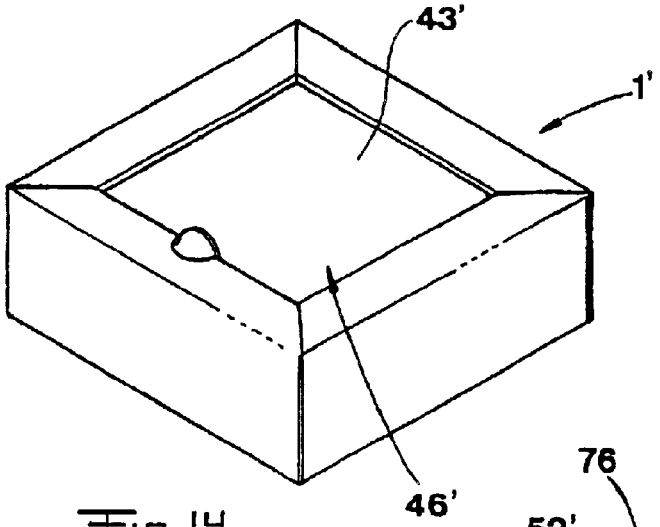
FIG. 14 is a view illustrating a package somewhat modified with an attachment for forming a cover.

In FIG. 14 an embodiment in which a package 1' receives an attachment 46' is illustrated. This attachment 46' forms a cover 43'.

Figure 16:
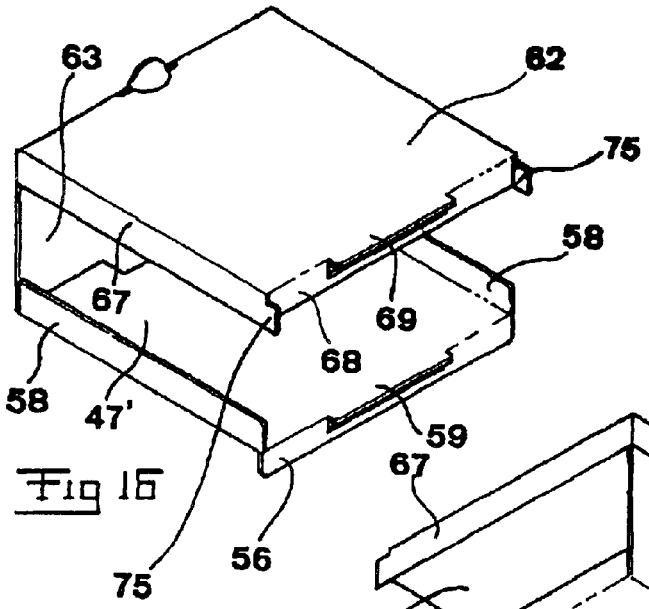
FIG. 16 and FIG. 17 are perspective views from opposite directions illustrating the attachment itself.
Figure 17:
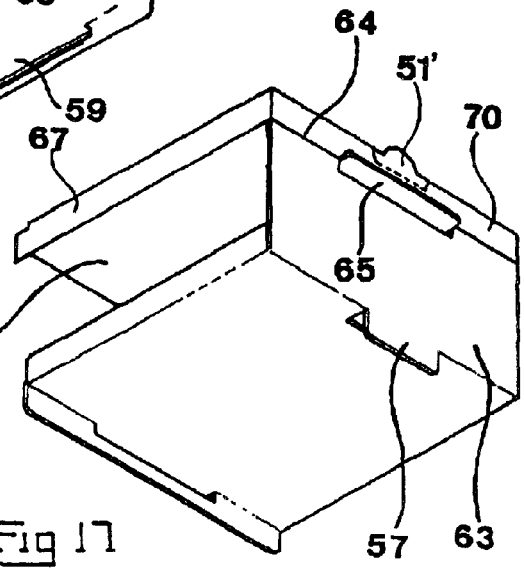
Figure 18:
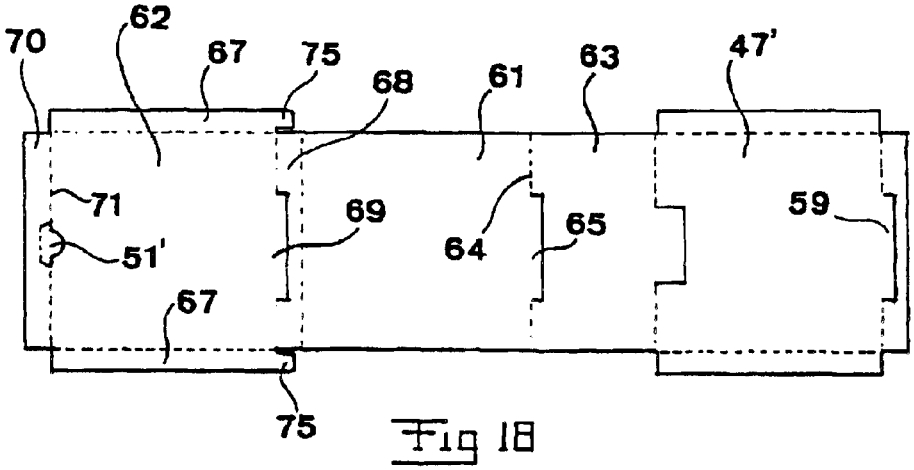
FIG. 18 is a view illustrating a foldable blank for forming the attachment according to FIGS. 16 and 17 in a plane unfolded state.

In FIG. 16-18 the attachment itself is illustrated. As appears this attachment has a bottom portion 47' and means for locating this bottom portion at a distance above a bottom 2' of the package so that a double bottom is the result. More precisely the locating means of the bottom portion is represented by tips 56 and 57, respectively, protruding downwardly. In the example the bottom portion 47' also has side tips 58 but these are here meant to be folded upwards during giving rigidity to the bottom portion 47'. However, it is pointed out that a variant within the scope of the invention is to fold the side flanges 58 downward so that they will be in contact with the bottom of the package.

Figure 15:
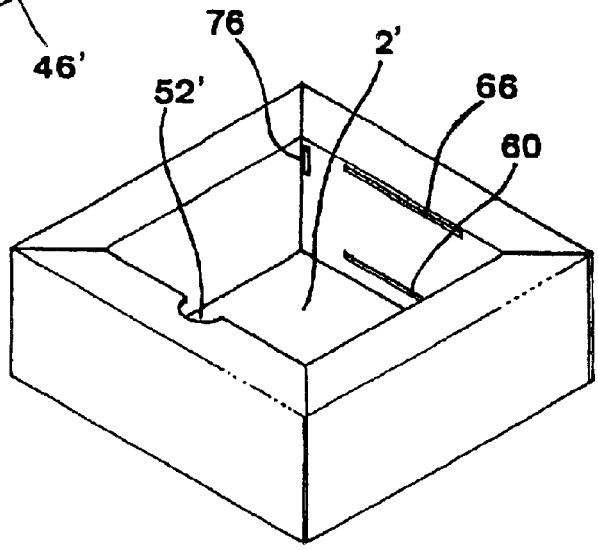
FIG. 15 is a view of the package itself according to FIG. 14 with the attachment removed.

In the tip 56 a locking tip 59 is designed which remain in the plane of the bottom portion when folding the end tip 56 of the bottom portion 47' downwards and which is intended to engage into a cut 60 arranged in an inner wall of the package (see FIG. 15) for locking purposes.

The attachment has as appears from FIG. 16-18 two lock panels 61, 62 arranged at a mutual distance. Thus, the cover becomes double-walled.

The bottom portion 47' of the attachment is connected with the cover forming panels 61, 62 via a panel element 63 arranged to extend parallel and close to one of the inner walls of the package when the attachment 46' is located in the package. The panel element 63 passes into the lower cover panel 61 via a folding line 64, whereby a further locking tip 65 is created by the folding as a consequence of cuts delimited by the tip. This tip 65 is intended to be received in a further cut (not to be seen in FIG. 15) arranged in the package in a wall opposite to the wall which has the cut 80.

The upper cover panel 62 has lateral flaps 67, which in the example are folded downward and therethrough will stiffen the cover panel 62. At the passage between the cover panels 61 and 62 a panel portion 68 limited by folding lines is arranged. This panel portion 68 will extend substantially vertically in the normal position of the attachment in the package as appears from FIG. 16 and as a consequence of cuts arranged in the cover portion 68 a locking tip 69 fitting in the cut 66 is created. At the outer end of the cover panel 62 there is a further panel portion 70, which is folded downwardly about a folding line 71 so that it will be located substantially in level with the panel element 63. The attachment 46' has a further locking tip 51', which is intended to cooperate with a recess 52' In a locking way in similar to what is described in connection with the first treated embodiment. As can be seen the locking tip 51' Is cut out in the panel portion 70 and/or the cover panel 62.

The two locking tips 65 and 69 are arranged to automatically be brought into and out of engagement with associated cuts in the package when pivoting of respective lock panels 61 and 62. Starting from that the attachment being inside the package and the cover is closed (corresponding to the position according to FIG. 16) thus the locking tip 69 is lockingly received in the cut 66. When the upper lock panel 62 is pivoted in opening direction about the present folding line in relation to the lower cover panel 61 the locking tip 69 will also pivot and be moved out of engagement in the cut 68. In the opposite way the locking tip 69 moves automatically into the cut 66 when the cover panel 62 is pivoted in locking direction. The corresponding applies to the locking tip 65 associated to the lower cover panel 61. When the lower cover panel 61 thus is pivoted in opening direction the locking tip 65 will follow the pivot motion about the folding line 64 and move out of engagement with the cut associated thereto. Inversely, the locking tip 65 moves into this cut to locking when the lower cover panel 61 is pivoted in closing direction. It is pointed out that in normal opening of the attachment first the upper cover panel is opened and then the lower is pivoted in opening direction. Further, it is noted that the pivoting centre of the upper cover panel 62 in relation the lower cover panel 61 is located on the opposite side in relation to the pivoting centre between the lower cover panel 61 and the panel element 63.

Especially, it appears from FIGS. 16 and 18 how the lateral flaps 67 of the upper cover panel may have locking tips 75 forming extensions in the area of the pivoting centre of the upper cover panel. These locking tips 75 cooperate with cuts 76 in the package, which are clear by FIG. 15, in a corresponding way that the locking tip 69 cooperates with the cut 66. By the fact that the locking tips 75 have the plane thereof orientated substantially across the pivoting centre of the upper cover panel 62 the locking tips 75 will receive fairly great rigidity perpendicularly to said pivoting centre, which gives an improved locking result.

Thus, the attachment 46' described provides double walls regarding the bottom in the package as well as its cover, something which makes that a product located inside the package between the bottom portion 47' of the attachment and the cover panel 61 receives a good protection against destroying effecting from outside.

Certainly, it is possible to modify the embodiments described herein in many ways, without departing from the scope of the idea of the invention presented. Accordingly, such variation possibilities by experts are included within the scope of the claimed protection. It is pointed out that the invention not is restricted to any special material as long as the material has such a foldiness which is a requirement for the invention. Thus, as material for the package and its attachments paper, card-board and pasteboard, plastic etc. are possible.

Especially it is pointed out that the package not necessary needs to have four walls as it is illustrated in the drawings. Thus, every even number of walls is possible according to the idea of the invention. In addition, it is pointed out that within the scope of the subsequent claim 1 such embodiments in which the package includes only two walls and a bottom are included to. For example the idea of the invention would be realised with only two walls and a bottom, namely as a corner package to be used for example for spare of corner in transport of objects such as for example plates, doors or the like. Finally, it is also pointed out that the bottom in the package not necessary needs to be completely covering. Thus, the bottom plate would have a recess, in which case the wall structure would tend to form a ring formation with a central opening.

What is claimed is:

1. A device at a package which in its erected state comprises a bottom (2) and hollow walls (3–6) protruding upwards therefrom, which walls each has an internal (12–15) and an external (16–19) wall portion located at a mutual distance while forming a cavity therebetween, and panel portions (20–23), which form upper edges of the walls of the package and which connect the internal and external wall portions to each other, said package being made of a foldable blank having a bottom portion (7), wall assemblies (8–11) protruding therefrom and comprising the internal (12–15) and external (16–19) wall portions and the panel portions (20–23), and an arrangement for locking the package in its erected state, which arrangement comprises one or more locking tips (25, 26, 32, 33), said wall assemblies (8–11) of the blank having flaps (24, 27, 31, 34) at their ends turned away from the bottom portion (7), said package being erected by pivoting the wall assemblies of the blank inwards toward the middle of the package so that the walls are formed and the flaps bear upon the upper side of the bottom portion (7) in the erected state of the package and are located below the panel portions (20–23), characterized in that at a corner formed by two adjoining walls (3–6) extending in an angle toward each other, a locking tip (25, 26, 32, 33) is connected with the internal wall portion (12–15) of a first of the walls by means of a folding line, which locking tip protrudes into the cavity of the other of the walls in the corner and which is arranged to lock the first wall in place by bearing against the inner side of the panel portion (21, 23) of the other wall at a position adjacent to a folding line between the panel portion and the external wall portion (17, 19) associated thereto.

2. A device according to claim 1, characterized in that each of the flaps (24, 27, 31, 34) are arranged to bear against the inside of the external wall portion (16–19) associated thereto by its outer edge.

3. A device according to claim 1, characterized in that the package has an even number of walls (3–6).

4. A device according to claim 1, characterized in that at a package with four walls (36), two opposite (3, 5) of these walls have two locking tips (25, 26, 32, 33) connected with their internal wall portions (12, 14) and located in the cavities of adjoining walls (4, 6) for locking the walls having the locking tips in place by bearing against the inner side of the panel portions (21, 23) of the walls without such locking tips.

5. A device according to claim 1, characterized in that the package forms a non-closed construction by having two walls only and a bottom.

6. A device according to claim 1, characterized in that two locking tips (25, 26, 32, 33) received in a cavity of a wall (4, 6) and associated to two adjoining walls (3, 5) have their outer ends in contact with each other and the inner side of the external wall portion (17, 19) of said wall (4, 6), the cavity of which receives the locking tips.

* * * * *